US005930105A

United States Patent [19]

Pitel et al.

[11] Patent Number: 5,930,105

[45] Date of Patent: Jul. 27, 1999

[54] METHOD AND APPARATUS FOR AIR IONIZATION

[75] Inventors: Ira J. Pitel, Morristown, N.J.; Mark Blitshteyn, New Hartford, Conn.; Petr Gefter, San Francisco, Calif.

[73] Assignee: Ion Systems, Inc., Berkeley, Calif.

[21] Appl. No.: 08/966,638

[22] Filed: Nov. 10, 1997

[51] Int. Cl.[6] ..... H05F 3/06

[52] U.S. Cl. ..... 361/212; 361/213; 361/229; 361/235

[58] Field of Search ..... 361/212, 213, 361/220, 225, 229, 230, 235; 250/324–326

[56] References Cited

U.S. PATENT DOCUMENTS

| | | | |
|---|---|---|---|
| 3,120,626 | 2/1964 | Schweriner | 317/2 |
| 3,137,806 | 6/1964 | Schweriner | 317/2 |
| 3,156,847 | 11/1964 | Schweriner | 317/4 |
| 3,443,155 | 5/1969 | Schweriner | 317/2 |
| 4,216,518 | 8/1980 | Simons | 361/213 |
| 4,542,434 | 9/1985 | Gehlke et al. | 361/213 |
| 4,630,167 | 12/1986 | Huggins | 361/213 |
| 4,689,715 | 8/1987 | Halleck | 361/213 |
| 4,729,057 | 3/1988 | Halleck | 361/213 |
| 4,774,472 | 9/1988 | Blitshteyn et al. | 361/213 |
| 4,809,127 | 2/1989 | Steinman et al. | 361/213 |
| 4,872,083 | 10/1989 | Blitshteyn | 361/213 |
| 4,951,172 | 8/1990 | Steinman et al. | 361/213 |
| 5,008,594 | 4/1991 | Swanson et al. | 315/111.81 |
| 5,017,876 | 5/1991 | Wright et al. | 324/464 |
| 5,432,454 | 7/1995 | Durkin | 324/452 |

*Primary Examiner*—Fritz Fleming
*Attorney, Agent, or Firm*—Fenwick & West LLP

[57] ABSTRACT

Ionizing method and apparatus includes a pair of inverters to supply ionizing voltages to ionizing electrodes only during alternate halves of a duty cycle in which one inverter is actuated to operate at high oscillating frequency while the other inverter is inactive, and thereafter in an alternate half of the duty cycle in which the one inverter is inactive and the other inverter is actuated to operate at high oscillating frequency. Each inverter includes a return current path that combines in a common return path in which return currents may be monitored for selective control of one or both of the inverters. Small step-up transformers and other components operating at high oscillation frequency promote confined packaging of high voltage generators for convenient mounting adjacent a pair of ionizing electrodes to reduce lengths of heavily-insulated high-voltage cables between generators and electrodes. Each electrode only operates on one polarity of high voltage derived from half-wave rectified high-frequency oscillations during the actuation of the associated inverter. Closely-spaced mounting of the electrodes adjacent a web of material having net electrostatic charge to be neutralized facilitates alternately supplying ions of each polarity from separate ones of the electrodes to neutralize charge on the web.

43 Claims, 6 Drawing Sheets

| FIG. 3A | FIG. 3B |
|---|---|

VD+
82
60
9
T1
821501
MAGNA-
POWER
L1
821503
MAGNA-POWER
57
C4
.068
250V
T2
821501
MAGNA-
POWER
64
63
67
R2
4.7K
HV ASSEMBLY
D2
HER103
52
27
D3
HER103
D4
G20FS
C6
33PF
15KV
C7
100FP
15KV
56
76
84
C2
1
50V
C3
1
50V
C5
.1
50V
19
72
D5
G20FS
Q2
TIP50
Q1
TIP50
D1
1N4004
68
D6
1N4004
21
F1
MCR-5
L2
821503
MAGNA-POWER
VAC
VR1
V68ZA2
VAC RTN
C1
50

METHOD AND APPARATUS FOR AIR IONIZATION

FIELD OF THE INVENTION

This invention relates to apparatus and methods of providing positive and negative ions for controlling surface charge, for example, on stationary objects and on continuous moving webs of non-conductive material.

BACKGROUND OF THE INVENTION

Many industrial operations are confronted by the build up of static charge on work pieces which then contribute to undesirable particulate contamination, unwanted movement, or other undesirable physical parameters associated with the work pieces. In the preparation of continuous films of shoot plastic materials, extended lengths of non-conductive plastic films pass rapidly over one or more rollers and accumulate substantial electrostatic charge that then attracts surface contaminants, and inhibits tight compaction in take-up rolls, impedes surface coating processes, and otherwise interferes with safe processing of the films, Air ionizers are commonly positioned in close proximity to such moving webs to supply positive and negative ions for substantially neutralizing static charge on the web material. These air ionizers commonly contain pointed ionizing electrodes and operate at voltages of several kilovolts supplied to the ionizer via heavily-insulated cables from remote generators positioned away from the moving web. In large industrial applications, such webs may be several feet wide, operate at high linear speeds, and exhibit wide variations in the amount of static charge requiring neutralization at any given time or location along the moving web.

Typically, ionizing currents of about 0.1 to 10 microamperes per linear inch of the moving web are required for neutralization. The webs may vary in widths from several inches to 20 feet. This requires that the generators which supply such ionizers be capable of sustaining the output current of about 1–5 milliamperes at voltage levels of about 3–15 kilovolts.

Several types of electrical air ionizers are available for controlling static charges on the fast-moving webs. Ionizers that operate at alternating voltages at the power line frequencies of 50–60 Hz are especially capable of efficient neutralization at reasonable cost. Line AC voltage at power-line frequency is applied to a high voltage transformer, the secondary winding of which produces about 4 kV to 10 kV AC voltage at the power-line frequency. This secondary voltage is applied to ionizing electrodes that are commonly positioned within a grounded metal enclosure, with openings through which the electrodes extend. This creates very strong electric field in the vicinity of the electrodes for generating corona discharge. The corona discharge is used to create positive and negative ions in the surrounding air.

These conventional AC air ionizers provide alternating quantities of positive and negative ions around ionizing electrodes closely spaced adjacent to the moving web. Such ions migrate by electrostatic attraction toward the oppositely charged web to neutralize static charge on the web. However, the web will attract the necessary ions of the requisite polarity and the excess ions will return to the electrodes or to the grounded enclosure. In the case of substantially neutral or uncharged webs, ions will not flow to it because of the absence of an electrical field. Operation in this manner provides a condition of self-balancing, and the excess of ions still available after the surface charge is neutralized generally do not cause overcompensation of the original charge on the web. However, in that process there is a considerable loss of the generated ions to ion migration back toward the electrodes when the polarity of the AC voltage reverses. The subsequent ion recombination with the electrodes leaves fewer ions available to neutralize static charge on the moving web and generally reduces the efficiency of such ionizers. Certain known AC air ionizers use two diodes connected to the output of the high voltage transformer to conduct currents of opposite directions and thus serve as half-wave rectifiers for the high voltages supplied through such diodes to ionizing electrodes of opposite polarities. The electrodes are located close to each other to help generate the intense electric field necessary for ionization. This arrangement prevents the electrodes from changing their respective polarities and thereby reduces the loss of ions back to the electrodes that generated the ions. In ionizers of this type, if a web does not carry static charge to attract ions, ions of one polarity generated around an electrode during one half cycle are attracted to and are neutralized at the other electrode of opposite polarity during the subsequent half cycle, thereby providing self-balancing operation. All such conventional ionizers require heavily-insulated cabling between ionizing electrodes and high-voltage transformers mounted remotely from the electrodes because of the large size and heavy weight of such transformers.

Another problem is that such conventional AC ionizers generally are incapable of measuring and monitoring the ionizing currents without employing complex external sensors and circuitry. That difficulty arises from the fact that the alternating potential applied to the electrodes couples capacitively to the electrically grounded components of the ionizer and the generator to produce a significant capacitive current that has a different phase and can substantially exceed the ionizing current. As a consequence, feedback control of AC high voltage ionizers is very difficulty, and the ability to selectively and independently control positive and negative output voltages in AC ionizers can only be achieved using more complex and expensive generator circuitry.

Other known air ionizers of the bipolar pulsed DC type resolve issues of size and weight by using small-size switching generators operating at high frequency. Bipolar pulsed-DC ionizers are capable of detecting the ionization current without employing complex external sensors and accompanying circuitry. For example, the voltage drop across a ground return resistor through which a flow of electrical charges is conducted away from the ionizing electrode can be sensed to provide an indication corresponding to the ionization current. (See, for example, the apparatus described in U.S. Pat. No. 4,809,127). However, this apparatus only monitors its own internal parameters and generally does not respond to charge levels on a moving web or other workpiece. These schemes using pulsed DC voltages of positive and negative polarity supplied to separate ionizing electrodes are also known to avoid the loss of ions back to the electrodes, both by separating the electrodes in space and operating only one electrode at a time, and thus improve ionization efficiency. However, such schemes are limited in pulse repetition frequency due to rise and decay times of the pulses of opposite polarity that tend to overlap at high switching rates. Such ionizers are commonly designed to operate at slow switching rates, typically 5 Hz maximum, to allow the ions to propel away from the ionizer (which is usually installed several feet above the surface to be neutralized) before the electrode of the opposite polarity becomes active and pulls back the ions produced in the previous cycle. Such ionizers generally require relatively large spacings (e.g., 3"–12") between the electrodes of opposite polarities. Circuitry design limitations commonly limit the alternating switching rate of the positive and negative generators to about 5 alternations per second. This low frequency makes pulsed DC technology impractical for neutralization of surface charges on fast-moving webs. Another limitation of these pulsed DC ionizers is the low output power of high voltage generators which are suitable for area ionization purposes, but typically insufficient for neutralization of surface charges on fast-moving webs.

Air ionizers that operate on dual steady-state DC high voltage supplies have found only a limited use for neutralization of surface charge on moving webs. This is due to the difficulty of controlling balanced positive and negative ion generation, and due to the propensity of such ionizers to charge the surface instead of neutralize surface charges. While it is possible to achieve balanced ionization with steady-state dual DC ionizers, considerably higher costs are involved relative to AC ionizers. Devices of the types described above are disclosed in the literature (See, for example, U.S. Pat. No. 5,432,454).

SUMMARY OF THE INVENTION

In accordance with the present invention, two high voltage generators are operated to produce positive or negative voltages of about 3–15 kilovolts The positive high voltage and negative high voltage are supplied to separate respective electrodes that are positioned in close proximity to the work piece (e.g., a moving web) to be neutralized with air ions. The generators which apply high voltages of predetermined polarities to the respective electrodes include ground return electrical paths through which electrical charges of polarities opposite to those of the electrodes are conducted away from the generators at rates corresponding to the rates of air ion generation by the respective electrodes. Also, the respective ground return paths of the two high voltage generators are connected to a summing junction and associated metering circuitry.

In accordance with the illustrated embodiment of the present invention, the positive electrodes act as the electrical potential reference for the negative electrodes positioned in close proximity thereto, and the negative electrodes act as the electrical potential reference for the positive electrodes to produce the desirable intense electrical field required for air ionization. With the ionizing electrode of one polarity positioned in close proximity to an electrode of the opposite polarity, and the sufficient potential difference between the electrodes, substantially all ionizing current from positive electrodes flows to the negative electrodes, and substantially all ionizing current from negative electrodes flows to the positive electrodes in the absence of an external electrostatic field from a charged surface (or when only a weak field is present) in the immediate vicinity of the ionizing electrodes. Accordingly, when there are substantially no external electrostatic fields from a charged surface, such as moving web, in the vicinity of the ionizer electrodes, substantially all ion currents flow between the electrodes of opposite polarities, and the DC component of the current in the system ground return will be substantially zero. If the web, however, carries surface charge, the associated electrostatic field causes ions of the polarity opposite to the polarity of the surface charge on the web to leave the ionizer electrodes and flow to the charged surface.

For example, when the moving web carries a negative electrostatic charge, its electrostatic field attracts the ions from positive electrodes. As a result, some positive ion current flows to the moving web to neutralize its surface charge, while the ion current from the negative electrodes significantly flows to the positive electrodes or back to the negative electrode during the inactive half cycles thereof. The DC component of the current in the system ground return thus changes from zero to the value directly related to the ion current that flows to the surface of the charged web. The resultant current that leaves the ionizer can be measured or otherwise monitored in the common ground return path as an indication of the polarity and magnitude of the charge on the surface. In accordance with the method of the present invention, the ionizer acts as a sensor for the charge on the work piece. A signal from the ionizer can then be used to control the outputs of the generators without the need for external sensors.

In the other embodiment of the present invention the ionizing currents from the electrodes are balanced in a setting resembling actual industrial installations where such ionizers are located near electrically grounded metal machine frame components. In such conditions, if a web of material carries negligible or small static charge, some ions will still be flowing away from the ionizer toward the metal machine frame. That flow of ions, if it is not balanced, may cause unintended charging of the web. In order to make the above described method work in the industrial setting the DC component of the current in the common ground return path should be substantially zero when the surface, such as moving web, does not carry static charges. This is accomplished by placing the ionizer electrodes in proximity to the grounded metal member, such as a plate, and the voltages applied to the ionizing electrodes are adjusted until the DC component of the current in the common ground return equals substantially zero.

The associated high voltage generators may be of many different types for producing positive and negative voltages of different wave shapes and amplitudes. The advantage of the present invention is significantly increased when the two high voltage generators are operated to produce positive or negative voltages of about 3–15 kilovolts during respective operational half-cycles at a selected switching or repetition rate. In operation during one half of the switching duty cycle, the first generator produces only positive half-cycles of high-voltage and the other generator is substantially inactive. Then, during the alternate half of the switching cycle, such other generator produces only negative half-cycles of high-voltage and the first generator is substantially inactive. In each half duty cycle of the applied AC power, the potential of ionizing electrodes connected to the active high voltage generator is elevated to air ionization levels while the ionizing electrodes connected to the inactive generator serve as a ground (or zero potential) reference. Quantities of positive and negative air ions accumulate around the ionizing electrodes. Ions of opposite polarity to the charge on the web are attracted toward the web. Ions of the same polarity as the charge on the web, and excess air ions of the first polarity that were not attracted to the web due, for example, to low levels of static charge on the web, are more actively attracted back either to the electrode that generated them when its potential changes substantially to zero, or to the electrode of opposite polarity during the excitation thereof. These effects contribute significantly to self-balancing ionization and neutralization of the net static charge on a moving web. However, this self-balancing does not result in high loss of ions, as in conventional AC ionizers, where the same electrodes that change polarities pull back significantly higher portions of the ions generated in the previous half-cycle.

The high voltage generators in one embodiment of the invention include multiple stages of power conversion in which the high voltage output is produced by a high frequency inverter (operating typically at a frequency greater that 20 KHz). Therefore the high-voltage, step-up transformers can be reduced in size and weight for convenient packaging and mounting adjacent the ionizing electrodes near the work piece. This eliminates heavily-insulated, high-voltage cabling conventionally utilized in A.C. ionizers between the electrodes and remotely-located high voltage generators. The alternating rate at which the generators are activated and inactivated may be in the range preferably between 50 cycles per second and 400 cycles per second.

In one embodiment of the present invention, the output of the high voltage generators during their respective inactive half cycles are caused to be at substantially lower electrical potentials so that the ionizing electrodes connected to the associated generator act as the electrical potential reference to the active ionizing electrodes to produce the desirable intense electrical field required for ionization.

In one embodiment of the present invention, the outputs of one or both of separate high voltage generators are selectively and independently controlled to control the net ion output. This allows desired levels of positive and negative ion currents to be achieved by changing the high voltages applied to the respective ionizing electrodes. In this manner, the ratio of ion currents can be changed over a wide range from only positive ions to only negative ions, and including generally equal positive and negative ion currents for balanced ionization in order to neutralize the surface charge of any polarity and magnitude on a fast-moving web. In this embodiment, the ion current attributable to one polarity of high voltage may be maintained at maximum level by reducing the high voltage applied to the electrode of the other polarity in order to most effectively neutralize surface charge of a known polarity. The ionizer may also be used as a charging device where desirable, for example, by installing electrodes adjacent to a metal roller that carries the web, and adjusting the output of the high voltage generators to produce predominantly positive (or predominantly negative) ions.

DETAILED DESCRIPTION OF THE INVENTION

Figure 1A:
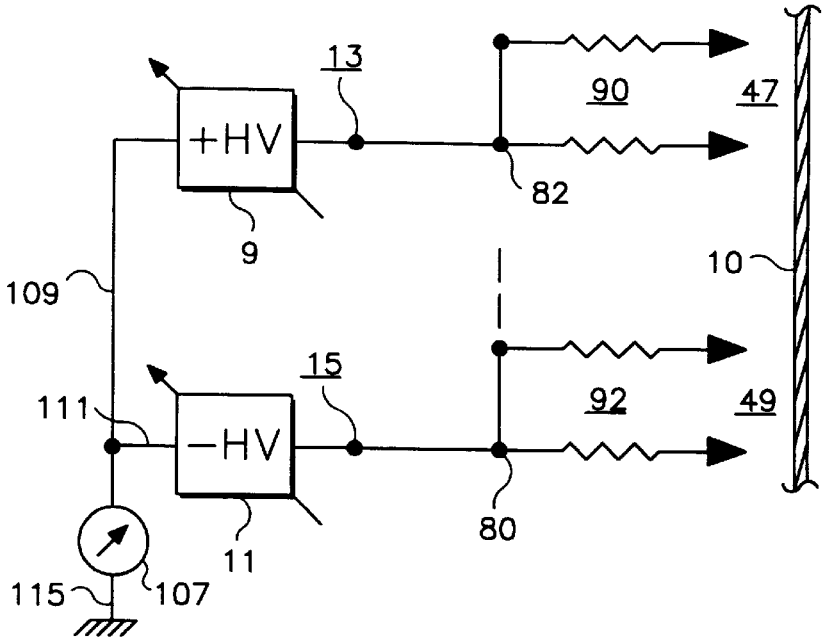
FIG. 1A is a block schematic diagram of one embodiment of the present invention.

In accordance with the present invention, two high-voltage generators 9, 11 are operated, as illustrated in FIG. 1A, to produce only positive (or negative) high voltages 13, 15 on respective outputs 80, 82. The output voltages from each generator 9, 11 are supplied to respective sets of ion emitter electrodes 47, 49 that are conventionally formed as sharp tips or points oriented toward a workpiece that is to be neutralized by the supplied ions. Additional resistors 90, 92 of high resistance values (e.g., 20 to 200 megohms) may be connected between output terminals and ion emitter electrodes 47, 49 to limit maximum output current for safety purposes. The electrodes 47,49 are positioned in close proximity to the work piece 10 (e.g., a moving web) to be neutralized with air ions. The generators which apply high voltages of predetermined polarities to the respective electrodes include ground return electrical paths 109 and 111 through which electrical charges of polarities opposite to those of the electrodes are conducted away from the generators at rates corresponding to the rates of air ion generation by the respective electrodes 47 and 49. Also, the respective ground return paths of the two high voltage generators are connected to a summing junction 113, similar to the circuitry described in U.S. Pat. No. 4,809,127 issued Feb. 28, 1989 to Arnold J. Steinman et al., and to the associated metering circuitry 107 in the common ground return path 115. However, unlike the above mentioned prior art, in the present invention substantially all ionizing current from positive electrodes flows to the negative electrodes, and substantially all ionizing current from negative electrodes flows to the positive electrodes in the absence of an external electrostatic field from the surface 10 (or when only a weak field is present) in the immediate vicinity of the ionizing electrodes. This is achieved by a combination of a specific distance between ionizing electrodes of the opposite polarities, where each ionizing electrode of positive polarity 47 is positioned in close proximity to an electrode of the negative polarity 49, and by the potential differences between the electrodes of opposite polarities. Under these conditions, the DC component of the current in the common ground return path 115 may be substantially zero when there are substantially no external electrostatic fields from a charged surface in the vicinity of the ionizer electrodes. When an adjacent surface 10 has a charge on it, the associated electrostatic field causes ions of the polarity opposite to the polarity of the surface charge on the web to leave the ionizer electrodes and flow to the charged surface. The resultant current that leaves the ionizer can be measured or otherwise monitored in the common ground return 115 as an indication of the polarity and magnitude of the charge on the surface.

Figure 1C:
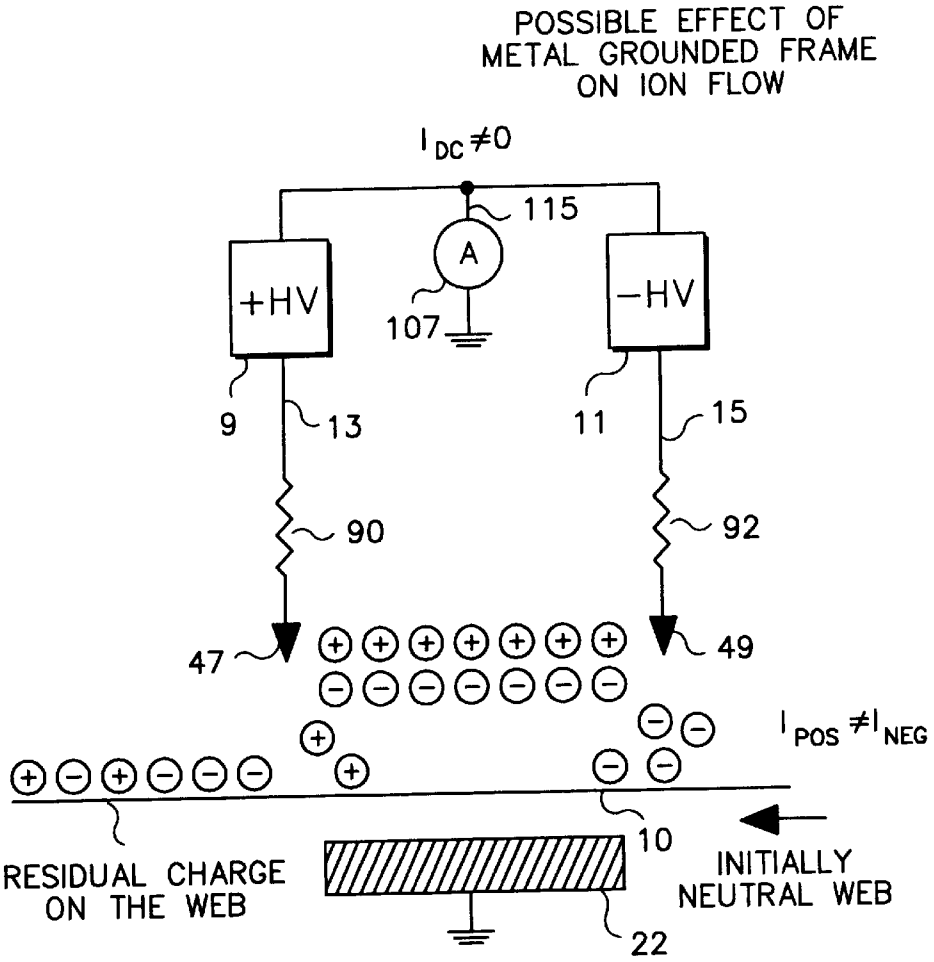
FIG. 1C is a block schematic diagram of one embodiment of the present invention operating in non-balanced mode.
Figure 1B:
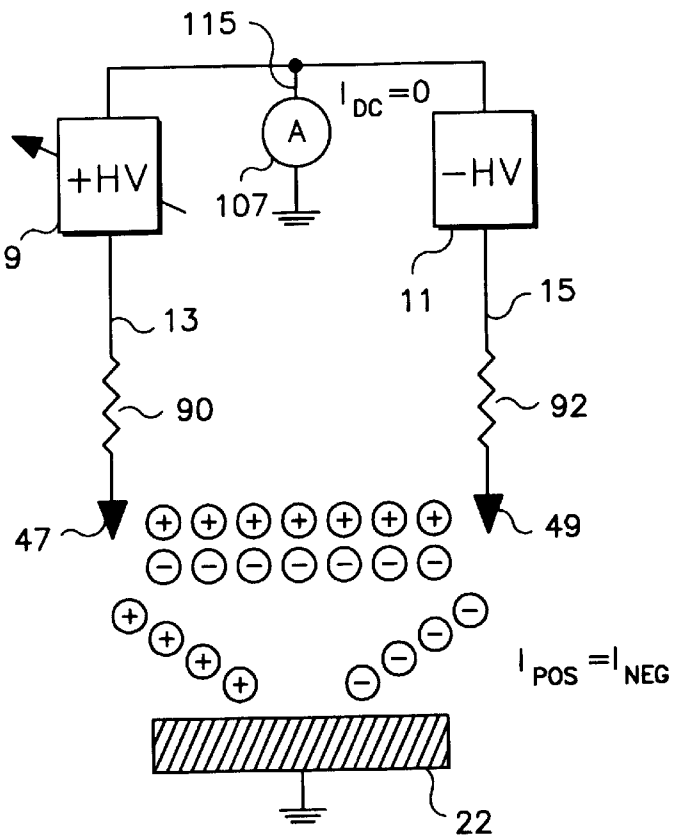
FIG. 1B is a block schematic diagram of one embodiment of the present invention operating in self-balanced mode.

FIG. 1B shows an embodiment of the present invention in which the ionizer is placed at a set distance from a electrically grounded metal plate 22 to simulate typical industrial installations. The current in the common ground return path 115 is measured with the metering circuit 107. The output of the high-voltage generator 9 (or of the high-voltage generator 11) is controlled to vary the effective ionizing potential supplied to the electrodes 47, while the ionizing potential on the electrode 49 is unchanged, until the ionizing currents from the electrodes are balanced and the DC component of the current in the common ground return is substantially zero. As illustrated in FIG. IC, an imbalance in the quantities of positive and negative ions supplied to an initially neutral web 10 may produce residual charge on the web at locations downstream of the ionizer.

In one embodiment of the present invention the two high voltage generators 9, 11 are operated to produce positive or negative voltages of about 3–15 kilovolts during respective operational half-cycles at a selected switching or repetition rate. In operation during one half of the switching duty cycle, one generator produces only positive half-cycles of high-voltage and the other generator is substantially inactive. Then, during the alternate duty cycle, such other generator produces only negative half-cycles of high-voltage and the one generator is substantially inactive. The operating duty cycles may be conveniently determined by power line frequency for alternately activating each of the separate high-voltage generators 9, 11 to produce half-cycles of high-voltage 13, 15 on the outputs 80, 82.

Specifically, each generator 9, 11 includes circuitry for operating at high frequency of about 20 kilohertz on applied electrical power, and such high frequency operation conveniently reduces the size and weight of voltage step-up transformers used to produce the high peak output voltages 13, 15 of one or other polarities.

Figure 2:
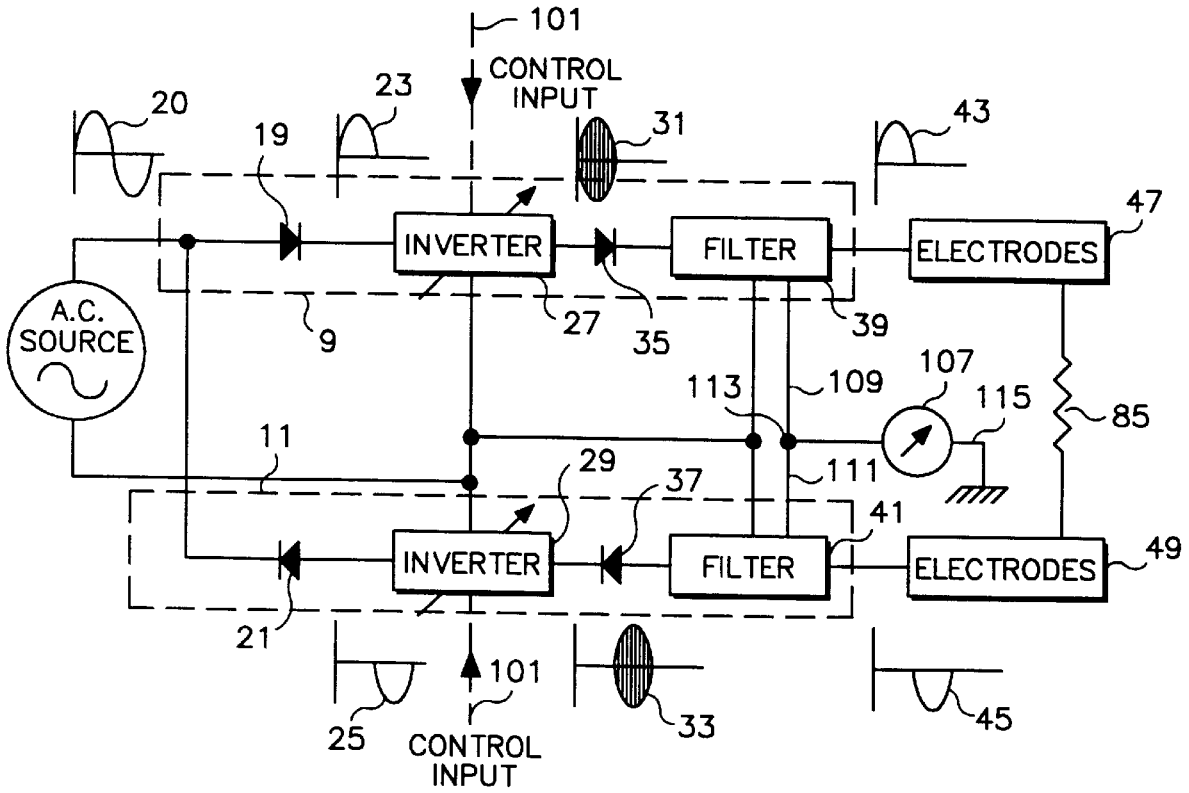
FIG. 2 is a block schematic diagram of the high-voltage generators of FIGS. 1A, 1B and 1C according to one embodiment of the invention.

Referring now to FIG. 2, there is shown a block schematic diagram of the circuit stages including high-voltage generators 9, 11 whose ground return paths, in one embodiment, may be connected to one summing junction 113. The generators 9, 11 receive alternate half waves of applied power (e.g., conventional AC power-line supply) via respective half-wave rectifiers 19, 21. The alternate half-cycles 23, 25 of the applied AC power 20 thus power the respective inverters 27, 29 to produce oscillations 31, 33 at high frequencies of about 20 kilohertz only during alternate half-cycles of the applied AC power 20. Such high-frequency oscillations at high-voltages of about 3–15 kilovolts are then half-wave rectified by respective diodes 35, 37 to supply the resultant half-wave rectified, high-frequency, high voltages to the respective filters 39, 41. These filters remove the high-frequency components of the half-wave rectified voltages to produce respective high-voltage outputs 43, 45 that vary over time substantially as the half-wave rectified, applied AC power 23, 25 varies with time. The filtered output voltages 43, 45 are supplied to separate respective sets of ion emitter electrodes 47, 49 of the type and orientation, as previously described. The inverters 27, 29 may be controlled in response to applied control signal to vary the effective ionizing potential supplied to respective electrodes 47, 49. A resistor 85 is connected between the outputs of the high voltage generators to provide substantially zero potential on the output and associated electrode 47, 49 that is inactive during an alternate half-duty cycle. As shown in FIG. 2, the inverters 27, 29 may be directly controlled in conventional manner to alter the high voltage outputs supplied to the respective electrodes 47, 49 in response to applied control signal 101 derived, for example, as illustrated and described later herein with reference to FIG. 3.

Figures 3, 3B:
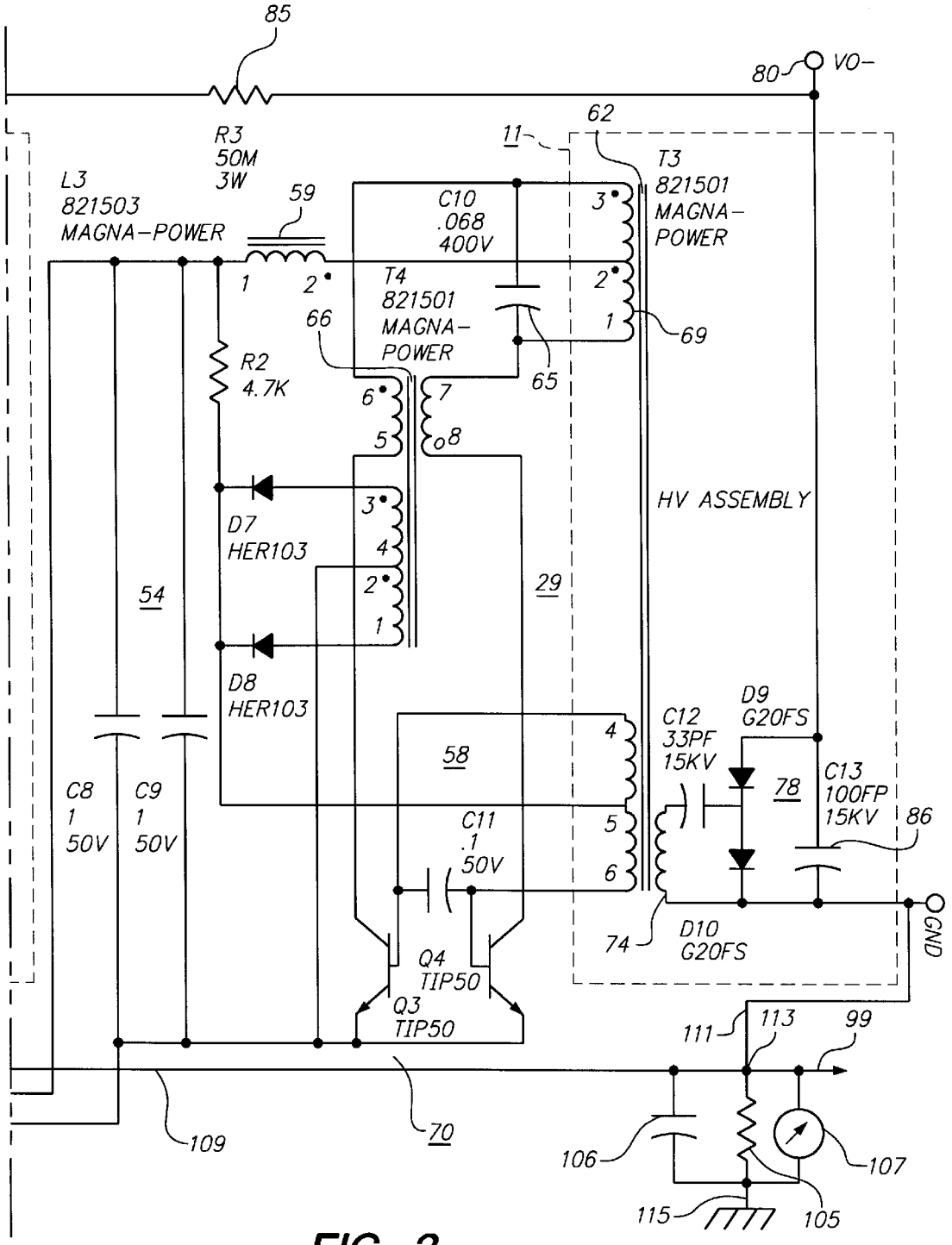
FIG. 3 is a circuit diagram of the generators of FIG. 1.
Figure 3A:
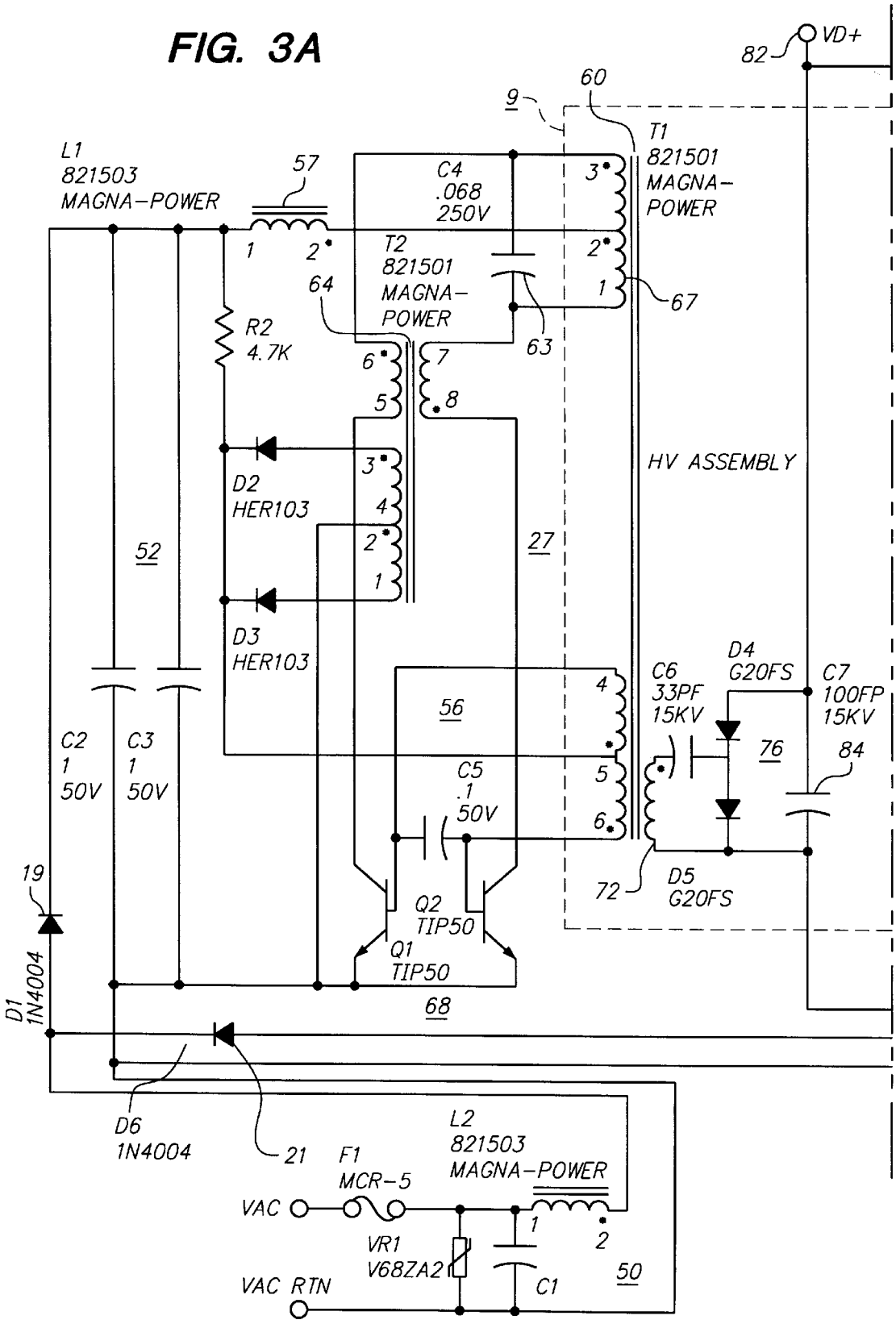

Referring now to the circuit diagram of FIG. 3, there is shown an input filter network 50 including a varistor and inductive and capacitive elements for protecting against power-line voltage transients and electromagnetic interference. The applied AC power at line, or other, frequency and any convenient voltage level (e.g., 24 volts, 120 volts, 220 volts, etc.) is applied via diodes 19, 21 to respective high-frequency inverters 27, 29. For each inverter, the half-wave rectified applied AC voltage is filtered 52, 54 for application to the high-frequency oscillators 56, 58 that include voltage step-up transformers 60, 62. The step-up transformers 60, 62 each includes windings connected in respective drain or collector circuits of transistor pairs 68, 70. The step-up transformers include windings coupled to the base or gate circuits of the transistor pair to form regenerative feedback loops that sustain oscillating operation during conduction of power-line current through the associated diode 19, 21, substantially at a frequency determined by the tank circuit of capacitance 63, 65 and the primary inductance of winding 67, 69. The inductors 57, 59 smooth current flow to the parallel-resonant tank circuits of coils 67, 69 and capacitors 63, 65. Current transformers 64, 66 sample the collector or drain currents of transistor pair 68, 70 to provide a proportional current of reduced magnitude to drive the transistor pair 68, 70. The proportional drive current allows operation over a wide range of input voltages encountered during the half-sine wave variations in each alternate cycle.

Figure 4:
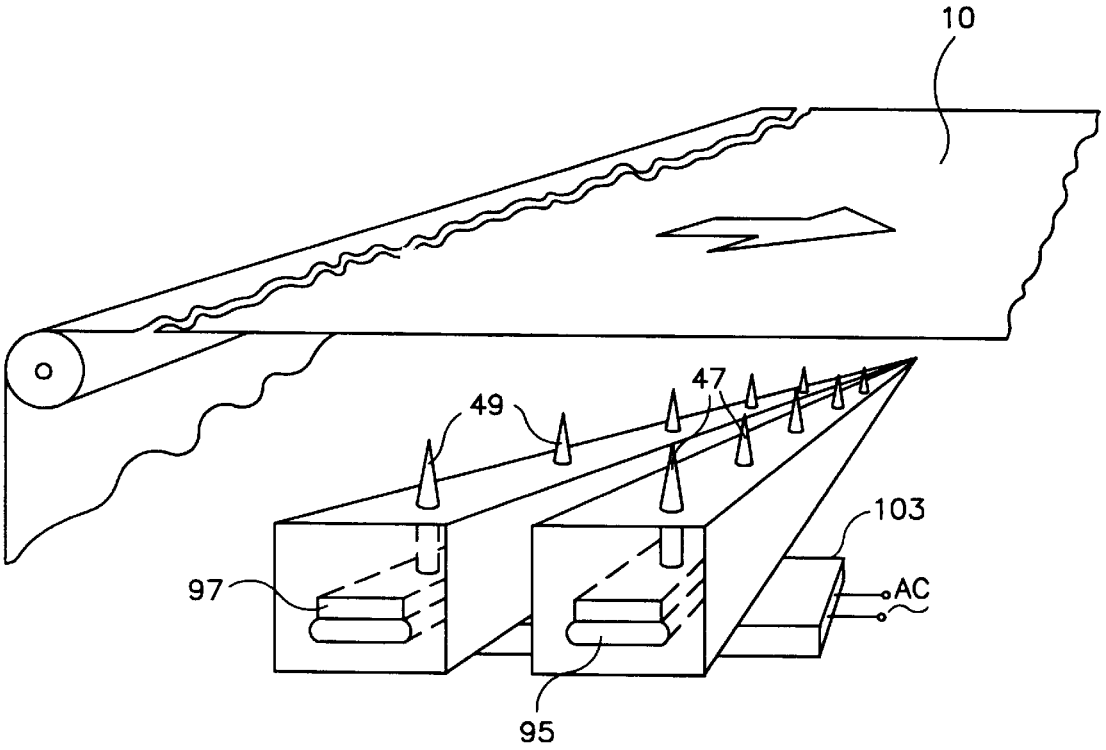
FIG. 4 is a perspective view of air ionizing electrodes positioned relative to a moving web to be neutralized.

Each step-up transformer 60 and 62 includes output winding 72 or 74 connected to capacitive voltage doubler circuits 76, 78 that produce rectified high-voltages on output terminals 80, 82 of one or other polarity. The rectified output voltages filtered via capacitors 84, 86 to provide the output voltages 43, 45 that are applied to the respective ion emitter electrodes 47, 49. The output voltages 43, 45 should be adjusted to such levels relative to each other, or to the system ground, that the ionizing electrodes 47, 49 generate positive and negative ion currents of substantially equal magnitude to facilitate balanced ionization conditions. The resistor 85 of very high resistance (e.g., 50 megohms) is connected between output terminals to discharge the filter capacitors 84, 86, and additional resistors 90, 92 of high resistance values may be connected between output terminals and ion emitter electrodes 47, 49 to limit maximum output current supplied by the voltage doublers 76, 78. The transformers 60, 62, 64, 66 and other components of small size for operation at high frequency promote convenient packaging in a common housing 103 for mounting with the ionizing electrodes 47, 49 near the moving web 10, as shown in FIG. 4. Such mounting obviates exposed high-voltage cabling between the high voltage generator and ionizing electrodes and promotes safe, low-voltage connections from an AC power source to the housing 103.

The metering circuit utilized to measure the DC component of the current in the common system ground return will be described in more detail. Electrical charges of polarities opposite to the charges on the ionizing electrodes are conducted away from the generators through the ground return electrical path 109 of the positive high-voltage generator 9 and ground return electrical path 111 of the negative high-voltage generator 11. The respective ground return paths 109 and 111 of the two high voltage generators are connected to a summing junction 113 and then to chassis ground through high resistance 105 which also functions as a return current sensing resistor. Further components of the metering circuit include a capacitor 106, connected in parallel with resistor 105 to serve as a filter. The voltage drop across resistance 105 is measured by DC voltmeter 107 or a similar instrument, as shown in FIG. 3. This system ground return current thus indicates or monitors the polarity and magnitude of the net ionizing current that flows from the ionizer to the charged surface, and can be sensed to provide information about the charge levels on the moving web, or about the operation of the ionizer, or may be used to supply signal to inverters 27, 29 as illustrated in FIG. 2 to control the levels of high voltages applied to the respective electrodes 47,49.

Referring now to FIG. 4, there is shown one embodiment of the electrodes 47, 49 connected to respective outputs 80, 82 and mounted in close proximity to a moving web 10. High voltage generators are packaged in a common housing 103 for mounting with the ionizing electrodes 47, 49 near the moving web 10. Such mounting obviates exposed high-voltage cabling between the high voltage generator and ionizing electrodes and promotes safe, low-voltage connections from an AC power source to the housing 103. In this configuration, rows of ionizing electrodes in the form of tapered pins 47, 49 are attached in common to high-voltage conductors 95, 97 of one or other polarity, and air ions of one polarity and then of opposite polarity are produced during alternate duty cycles in close proximity to the moving web 10 for controlling static charge on the web 10. In each half duty cycle of input signal, the potential on one row of pins or electrodes 47, 49 is elevated to air ionization levels (e.g., 3–15 kilovolts) while the other row of pins or electrodes serves as a ground (or zero potential) reference for establishing high field gradients around the pins or electrodes 47, 49 to promote air ionization.

In another embodiment, the ionizing electrodes of both polarities may be aligned in a single row in alternating (−), (+), (−), (+) orientations, with spacing between adjacent electrodes in the range of about ¼ to 2 inches, and with preferred spacing of about ½ to 1 inch. In still another embodiment, the electrodes are positioned in pairs so that each electrode for positive voltage has an electrode for negative voltage as a neighbor, where the distance between the electrodes in the pairs is shorter than the distance between the pairs of the electrodes.

Figure 5:
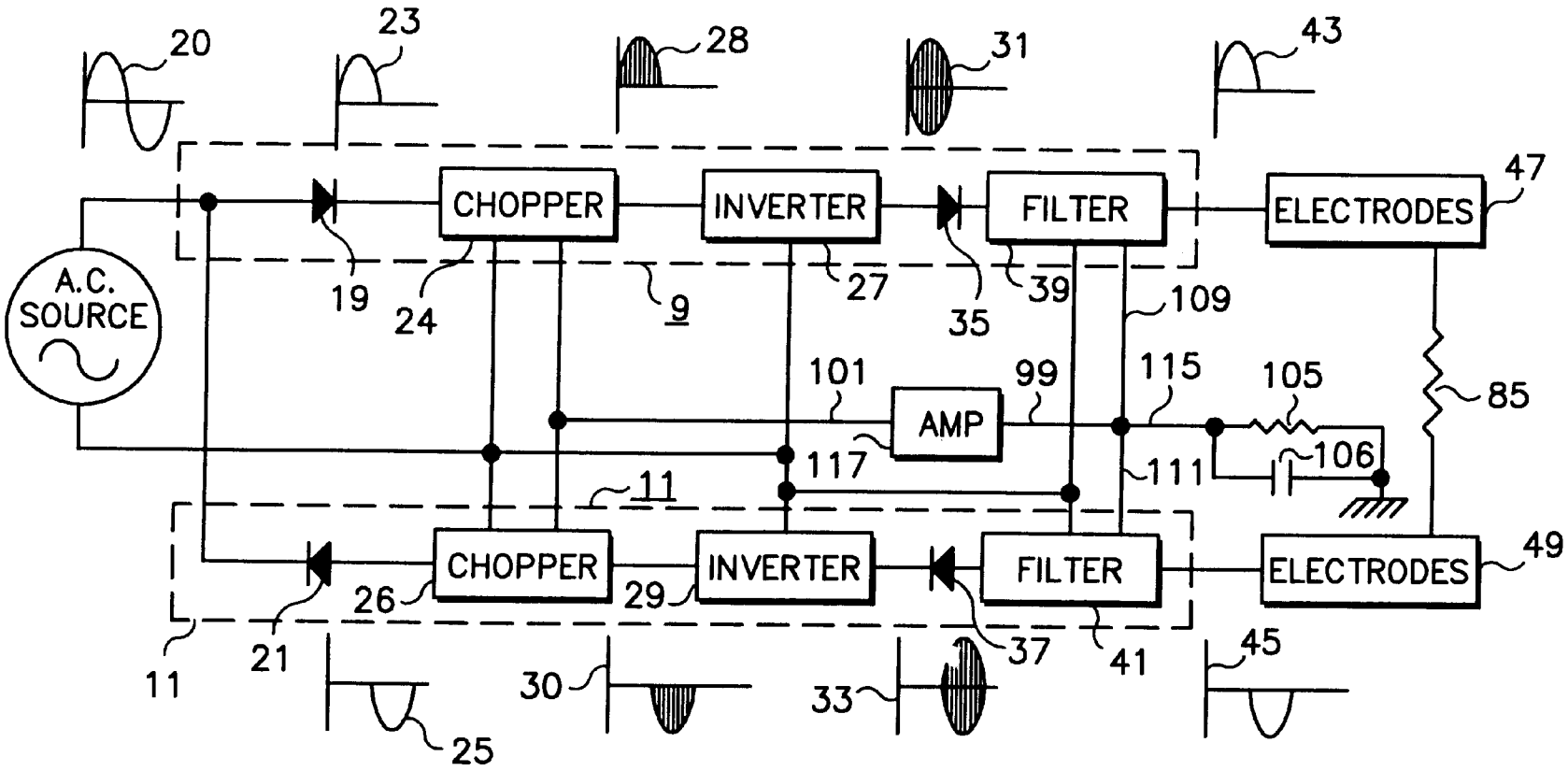
FIG. 5 is a block schematic diagram of the high-voltage generators of FIGS. 1A, 1B, and 1C according to another embodiment of the invention.

In an alternative embodiment, as illustrated in FIG. 5, conventional pulse-width modulators, or choppers 24, 26 are connected prior to the inverters 27, 29 to reduce the average (or integrated) input voltage 28, 30, but without substantially changing the envelope or waveshape of the voltage 28, 30 applied to the inverters 27, 29. The choppers 24, 26 as pulse-width modulators may include transistors, MOSFETs, or other similar switching devices which are turned off and on at frequencies comparable to the oscillation frequencies of the inverters with variable on-period controlled in response to applied control signal 101 derived from the output of an amplifier 117. The input of the amplifier 117 is connected to the metering circuit containing resistor 105 and capacitor 106. The ratio of the on-period to the total period (on and off) may remain constant over one complete half-cycle of the applied low frequency input 23, 25, with the result that the average output voltages of the choppers as applied to the inverters 27, 29 retain the half-sinusoidal waveshape at amplitudes that are reduced in relation to the reduction of the duty cycle.

The DC component of the current in the ground return path indicates or monitors the polarity and magnitude of the net ionizing current, and can be used to supply signal to the choppers 24, 26 as illustrated in FIG. 5, to control the levels of high voltages applied to the respective electrodes 47, 49. In this embodiment of the present invention, the self-balancing of charge neutralization on a moving web 10 may be enhanced by active control of one or other of the generators 9, 11 in response, for example, to the signal at the input 99 to the amplifier 117 that is representative of the net current in the system ground return.

In this embodiment, the circuit as illustrated in FIG. 5 produces a control signal 99 for application to one or both of the generators 9, 11 in the manner as previously described to alter the ionizing potential of the output voltage produced thereby. For instance, a signal in the ground return indicating net positive ion current going to a charged web may be used to decrease the output of chopper 26 in the negative generator 11, and thus reduce the voltage on negative ionizing electrodes 49. Lowering the negative voltage effectively reduces the number of positive ions attracted and recombined with the negative electrode 49.

The present invention may also be used to deposit charge on a surface by transferring the ions from the electrodes onto the surface for the purpose of, for example, so-called electrostatic 'pinning' of sheet and film material to other sheets or holding surfaces. To accomplish this, ionizing electrodes are positioned adjacent a grounded surface such as a metal roller which transports the film material. The high voltage generators are adjusted to generate different ratios of positive and negative ionization currents for a bipolar charging of the surface, or a preponderance of ions of one polarity at the associated electrodes for a largely unipolar charging of the surface. The Coulomb forces established between the electrodes and the grounded metal roller move the ions toward the film material supported on the roller, thereby to charge the web of film material.

Therefore, the high voltage generators, ionizing electrodes, and control schemes according to the present invention provide supplies of positive and negative ions for control of static charge on a work piece such as a moving web of dielectric material. Self-balancing or signal control of electrostatic charge neutralization by generated air ions thus promote control of surface charge, for example, charge neutralization substantially to zero net charge for enhanced processing of the web material.

What is claimed is:

1. A method for controlling static charges with a system including first and second ionizing electrodes connected to respective first and second high voltage generators that supply positive high voltage and negative high voltage seperately to the first and second ionizing electrodes for generating positive ions from the first electrode and negative ions from the second electrode, the method comprising:

establishing a common ground return for both said first and second high voltage generators;

conducting away a flow of electrical charges of opposite polarity from said first high voltage generator through the common ground return therefor at a rate corresponding substantially to the rate of ion production by the first ionizing electrode;

conducting away a flow of electrical charges of opposite polarity from said second high voltage generator through the common ground return at a rate corresponding substantially to the rate of ion production by the second ionizing electrode;

directing substantially all ions of one and another polarity produced by the first and second electrodes to flow between said first and second electrodes in the absence of an external electrostatic field in the region thereof;

disposing said first and second electrodes near a surface exhibiting electrostatic charge of various magnitude, including substantially zero charge, of one or other polarity for establishing thereby an electrostatic field near the first and second electrodes to cause a portion of ion current from the electrode of opposite polarity to flow to the charged surface;

establishing the combined flow of electrical charge from both of said first and second high voltage generators through the common ground return at a rate corresponding substantially to the rate of ion current flow directed to the charged surface; and sensing said combined flow of the electrical charges from both of said first and second high voltage generators.

2. The method according to claim 1 wherein the step of sensing the combined flow of electrical charges from both of said first and second high voltage generators includes measuring and monitoring the DC component of said combined flow of electrical changes.

3. The method according to claim 2 comprising:

removing substantially all external electrostatic fields in the vicinity of the said first and second electrodes;

establishing the combined flow of electrical charge from both of said first and second high voltage generators through the common ground return thereof to be substantially zero in the absence of an external electrostatic field.

4. The method according to claim 1 comprising:

actuating said first and second high voltage generators intermittently and alternately.

5. The method according to claim 4 wherein the actuating step, one of the first and second high voltage generators is actuated to produce high voltage output while the output of the other of the first and second high voltage generators is substantially zero.

6. The method according to claim 1 wherein the high voltage outputs of said first and second high voltage generators are independently adjustable.

7. A method for controlling static charges on surfaces using first and second ionizing electrodes connected to respective first and second high voltage generators that supply independently variable positive high voltage and negative high voltage separately to the first and second ionizing electrodes for generating positive ions from the first electrode and negative ions from the second electrode, the method comprising:

establishing a common ground return for both said first and second high voltage generators;

conducting away a flow of electrical charges of opposite polarity from said first high voltage generator through the common ground return at a rate corresponding substantially to the rate of ion production by the first ionizing electrodes;

conducting away a flow of electrical charges of opposite polarity from said second high voltage generator through the common ground return at a rate corresponding substantially to the rate of ion production by the second ionizing electrodes;

directing substantially all ions of one and another polarity produced by the first and second electrodes to flow between said first and second electrodes;

sensing the combined flow of electrical charges from both of said first and second high voltage generators through the common ground return;

further sensing a DC component of said combined flow of electrical charges from both of said first and second high voltage generators;

positioning the first and second electrodes at a distance from a conductive ground; and controlling said DC component of the combined flow of electrical charges from both of said first and second high voltage generators to be substantially zero.

8. The method of claim 7 wherein the step of controlling said DC component of the combined flow of electrical charges ion from both of said first and second high voltage generators to be substantially zero is accomplished by adjusting the level of the high voltage supplied by at least one of the first and second high voltage generators.

9. The method of claim 7 wherein said distance from a conductive ground is between one and six inches.

10. The method according to claim 7 for controlling charge on a surface, the method comprising:

positioning the first and second electrodes near the surface having electrical charge thereon for establishing an external electrostatic field in the vicinity of said first and second electrodes of one or another polarity to cause ion current to flow from the one of the first and second electrodes of opposite polarity to the charged surface;

establishing the combined flow of electrical charges from both of said first and second high voltage generators through the common ground return;

further establishing the DC component of said combined flow of electrical charges to substantially correspond to the rate of ion current flow directed to the charged surface; and sensing said DC components of the combined flow of electrical charges from both of said first and second high voltage generators.

11. The method according to claim 7 comprising:

actuating said first and second high voltage generators intermittently and alternately.

12. The method according to claim 11 wherein in the step of actuating, one of the first and second high voltage generators is actuated to supply high voltage output while the output of the other of the first and second high voltage generators is substantially lower.

13. A method for supplying ionizing potentials to electrodes for ionizing air from a pair of inverters, each operable to provide oscillations at high frequencies in response to applied electrical signal, the method comprising:

alternately applying electrical signals to the inverters to energize each of the inverters in phase opposition to oscillate at high frequency;

forming AC high-voltage output from the oscillations in each inverter; and rectifying the AC high-voltage output from each inverter to produce therefrom a half-wave rectified output from the AC high-voltage output during operation of the associated inverter in an interval while energized by the applied electrical signals to supply ionizing potential to the ionizing electrodes.

14. The method according to claim 13 comprising:

supplying ions produced at the ionizing electrodes to a web of moving dielectric material at a selected location traversed by the moving web to neutralize charge on the web; and sensing a combination of ion currents associated with the half-wave rectified outputs to provide a control signal for selectively controlling the produced ions in at least one parameter of quantity and polarity to reduce residual charge remaining on the web after movement thereof past the location at which ions are supplied to the web.

15. The method according to claim 14 wherein the control signal is supplied to at least one of the inverters for selectively altering the AC high-voltage output therefrom.

16. Apparatus for supplying ions comprising:

first and second electrodes disposed to ionize air;

a first high voltage generator coupled to the first electrode to apply positive high voltage thereto, and a second high voltage generator coupled to the second electrode to apply negative high voltage thereto, each of the first and second high voltage generators producing an independently adjustable high voltage output;

a common ground return path through which electrical charges of opposite polarity are conducted away from said first and second high voltage generators;

circuitry for actuating said first and second high voltage generators to supply, respectively, the positive and negative high voltages intermittently and alternately substantially at power line frequency;

a sensing circuit coupled in said common ground return path for sensing the combined flow of electrical charges from both of said first and second high voltage generators; and matching means for maintaining the combined flow of electrical charge in the said common ground return path at a rate corresponding substantially to the rate of ion flow from the first and second electrodes away from the apparatus in response to the external electrical field in the vicinity of said first and second electrodes.

17. The apparatus according to claim 16, wherein said matching means include the first and second electrodes spaced apart a distance at which substantially all air ions flow between said first and second electrodes in the absence of the external electrical field in the vicinity of said first and second electrodes.

18. The apparatus according to claim 17, wherein said matching means further include potential difference between the first and second electrodes at which substantially all air ions flow between said first and second electrodes in the absence of the external electrical field in the vicinity of said first and second electrodes.

19. The apparatus according to claim 16, wherein said matching means include a combination of the distance between the first and second electrodes and the potential difference between the first and second electrodes at which substantially all air ions flow between said first and second electrodes in the absence of the external electrical field in the vicinity of said first and second electrodes.

20. The apparatus according to claim 19, wherein said distance between the first and second electrodes ranges from about ¼" to about 4" and the potential difference between the first and second electrodes ranges from about 3,000 volts to about 15,000 volts.

21. The apparatus according to claim 16, wherein outputs of said first generator and of the said second generator are connected with a resistor.

22. The apparatus according to claim 21 wherein said resistor has the resistance value selected to establish the output of one high voltage generator at substantially zero when the other high voltage generator has high output.

23. The apparatus according to claim 16, wherein the first and second high voltage generators each operate at high frequency above power line frequency and include voltage step-up transformers of small size relative to step up transformers operable at power line frequency.

24. The apparatus according to claim 16 wherein each of the electrodes is disposed adjacent a web of material potentially exhibiting electrostatic charge to be neutralized for supplying thereto ions of one polarity during one operating cycle and for supplying thereto ions of opposite polarity during another operating cycle for reducing net electrostatic charge on the web.

25. The apparatus according to claim 16 for supplying ions to a charged object in which said sensing circuit provides indication of the magnitude and polarity of the net ion current in relation to the magnitude and polarity of the charged object.

26. The apparatus according to claim 16, wherein said sensing circuit in the common ground return path contains a resistor in the ground return path and a filter capacitor connected in parallel to the resistor, and a voltmeter to measure the voltage drop across said resistor created by the combined flow of electrical charges from the first and second high voltage generators.

27. The apparatus according to claim 16 wherein each of the electrodes is disposed adjacent a conductive surface that is in contact with a non-conductive material disposed intermediate the surface and the electrode for supplying to the material ions of one polarity during one operating cycle and for supplying thereto ions of opposite polarity during another operating cycle to provide net electrostatic charge on the material for developing attraction thereof to the conductive surface.

28. The apparatus according to claim 27 the outputs of the generators are operated to produce a preponderance of positive or negative ions by the ionizing electrodes.

29. Apparatus for supplying ions, comprising:

a first generator operable for providing high-voltage of one polarity;

a second generator operable for providing high-voltage of opposite polarity;

circuitry connected to the first and second generators for supplying thereto alternating input signal of selected frequency to operate said first generator on the positive half-cycle of the input signal to produce the high-voltage of said one polarity, and to operate the second generator on the negative half-cycle of the input signal to produce the high voltage of said opposite polarity; and ionizing electrodes coupled to receive the high voltage produced by respective ones of the generators for producing ions of one polarity on one of the ionizing electrodes during one half-cycle of the alternating input signal, and for producing ions of opposite polarity on another of the ionizing electrodes during the other half-cycle of the alternating input signal.

30. The apparatus according to claim 29 wherein said circuitry includes a pair of diodes connected in common to a supply of said alternating input signal, and including one of said pair of diodes connected to the first generator for actuating such generator during one half-cycle of the alternating input signal, and including the other of said pair of diodes to the second generator for actuating such generator during an alternate half-cycle of the alternating input signal.

31. The apparatus according to claim 29 wherein each of the electrodes is disposed in close proximity to an electrode of the opposite polarity to cause substantially all air ions to flow between said first and second electrodes in the absence of the external electrical field in the vicinity of said first and second electrodes.

32. The apparatus according to claim 29 wherein each of the electrodes is disposed in close proximity to an electrode of the opposite polarity to provide each electrode substantially zero reference potential in close proximity during each operating cycle.

33. The apparatus according to claim 29, wherein said high voltages provided by said first and second generators produce the potential difference between the first and second electrodes at which substantially all air ions flow between said first and second electrodes in the absence of the external electrical field in the vicinity of said first and second electrodes.

34. The apparatus according to claim 29, wherein each of the first and second generators comprises:

a half-wave rectifier connected to rectify the alternating input signal to produce a rectified low-voltage AC signal of one polarity for the first generator and of opposite polarity for the second generator;

an inverter in each generator connected to convert the low-voltage signal from the half-wave rectifier to high-voltage, high-frequency AC during the associated half-wave interval; and a second half-wave rectifier connected to each inverter to convert the high-voltage, high-frequency AC to half-wave rectified high-voltage during the associated half wave interval of the alternating input signal.

35. The apparatus according to claim 34 wherein each of the second halfwave rectifiers includes a voltage doubler including a first diode and a first capacitor serially connected to receive the high-voltage, high-frequency AC and including a second diode and a second capacitor serially connected across the first diode for producing said half-wave rectified high voltage across the second capacitor.

36. The apparatus according to claim 34 wherein the inverters including transformers and the rectifying circuits are disposed adjacent the electrodes to reduce lengths of high-voltage connections between electrodes and rectifying circuits.

37. The apparatus according to claim 29 comprising:

a circuit forming a common connection of the generators as a system ground for sensing combined return currents of the generators in the system ground to produce therefrom a signal that is indicative in magnitude and direction of the system ground combined return currents.

38. The apparatus according to claim 37 for supplying ions to a charged object in which said signal provides indication of the magnitude and polarity of the net ion current in relation to the magnitude and polarity of the charged object.

39. The apparatus according to claim 38 wherein at least one of the generators alters the high voltage output produced thereby in response to the applied control signal.

40. The apparatus according to claim 39, wherein the control signal is proportional to the system ground return current and alters the output of at least the one of the inverters to produce a selected ratio of positive and negative ions produced by ionizing electrodes connected to receive said high voltages of positive and negative polarities.

41. The apparatus according to claim 29, wherein the outputs of the generators are independently adjustable.

42. The apparatus according to claim 29 wherein each of the electrodes is disposed adjacent a web of material exhibiting electrostatic charge to be neutralized for supplying thereto ions of one polarity during one operating cycle and for supplying thereto ions of opposite polarity during another operating cycle for reducing net electrostatic charge on the web.

43. The apparatus according to claim 29 wherein the frequency of the alternating input signal is the frequency of power-line AC voltage.

* * * * *